United States Patent [19]

Iglesias et al.

[11] 4,183,532

[45] Jan. 15, 1980

[54] FLIPPER GAME WITH ADJUSTABLE DETAINER

[76] Inventors: Benito Iglesias, 3165 W. 8 Ave., Hialeah, Fla. 33012; Jose R. Garcia, 3885 NW. Flagler Ter., Miami, Fla. 33144

[21] Appl. No.: 884,146

[22] Filed: Mar. 7, 1978

[51] Int. Cl.[2] ..... A63B 67/12

[52] U.S. Cl. ..... 273/95 F; 273/106 R

[58] Field of Search ..... 273/95 F, 106 R, 102 S

[56] References Cited

U.S. PATENT DOCUMENTS

| | | | |
|---|---|---|---|
| 753,029 | 2/1904 | Astarita | 273/106 R |
| 907,571 | 12/1908 | Chesboro | 273/106 R |
| 2,878,801 | 3/1959 | Patchin et al. | 273/106 R |
| 3,232,618 | 2/1966 | Anderson | 273/95 F |
| 3,817,525 | 6/1974 | Henry | 273/95 F |
| 3,820,787 | 6/1974 | Heinbigner | 273/102 S |

FOREIGN PATENT DOCUMENTS

| | | | |
|---|---|---|---|
| 589556 | 8/1959 | Canada | 273/95 F |

*Primary Examiner*—Richard C. Pinkham
*Assistant Examiner*—Lawrence E. Anderson
*Attorney, Agent, or Firm*—Jesus Sanchelima

[57] ABSTRACT

This game is played by batting an elongated cylindrical flipper through the air. The flipper to be batted rests on a holder being supported by an adjustable stand. This holder has a cylindrical groove that keeps the flipper in place and an adjustable detainer that causes a flipper's end to protrude out of the holder's end. The flipper is batted by striking it twice, first to flip it up into the air from the holder and secondly, to impart a translational movement. The adverse party will try to catch the flipper with a stopper which resembles a stringless racquet-ball racquet with a net.

2 Claims, 8 Drawing Figures

FLIPPER GAME WITH ADJUSTABLE DETAINER

BACKGROUND OF THE INVENTION

1. Field of the Invention

This invention relates to games of the type in which an elongated cylindrical flipper is batted through the air by striking it twice, first to flip it up into the air and secondly, to impart a translational movement.

2. Description of the Prior Art

Games similar to the one described herein have been played in different localities with different rules and denominations for its implements. U.S. Pat. No. 1,387,946 issued to John Rutherford, Jr., and Thomas F. Baker, describes a game that, in the applicant's opinion, comes the closest to his invention.

BRIEF SUMMARY OF THE INVENTION

The object of the invention is to provide improved implements for games of the class herein described, introducing features which will increase the interest to the players and make the game easier to play. These novel features being the introduction of a stopper to facilitate catching the flipper, an adjustable stand to allow each player select the proper height, a holder that will keep the flipper in place and at the same time will allow each player to graduate the flipper's protrusion in accordance to his preference.

Another object of this invention is to provide the required implements to play this game safely and comfortably without sacrificing the features that make it interesting to play. All other games are played by batting the flipper, or its equivalent, from the ground. This makes it more difficult to flip the flipper into the air and it also limits the force that can be used since the player will end up hitting the floor at the end of the swing and thereby hurting himself.

Further features of the invention include the design and arrangement of the flippers, as well as the holder.

BRIEF DESCRIPTION OF THE DRAWINGS

Further details are explained below with the help of the examples illustrated in the attached drawings in which.

DESCRIPTION OF THE PREFERRED EMBODIMENT

Figure 1:
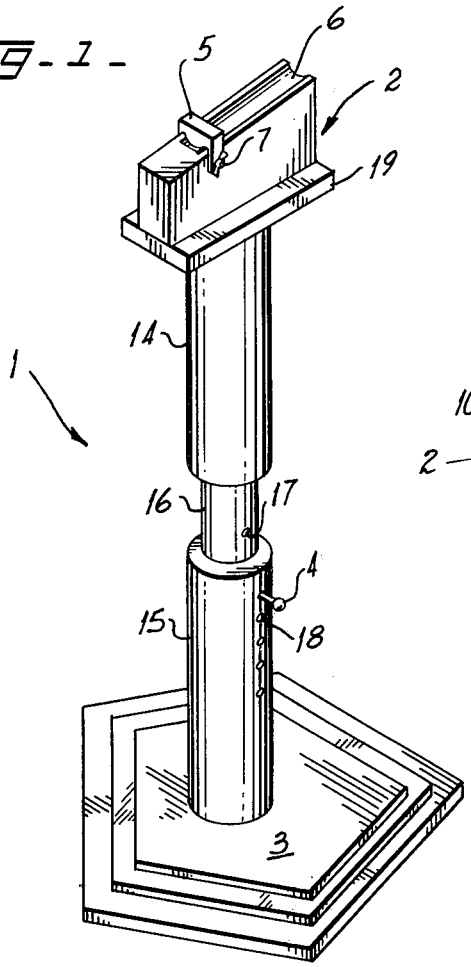
FIG. 1 is an overall view in perspective of the stand assembly.

In FIG. 1, the stand assembly 1 is shown resting on a base 3 that supports a lower cylinder 15 which engages with an inner cylinder 16 that is attached to an upper cylinder 14. Inner cylinder 16 slides through lower cylinder 14 and it is kept in a selected position by the height adjustment pin 4 when it pierces through a hole 18 on lower cylinder and penetrates a second hole 17 on inner cylinder. The different positions will provide a range of heights so that each player can select the most comfortable one.

Figure 1A:
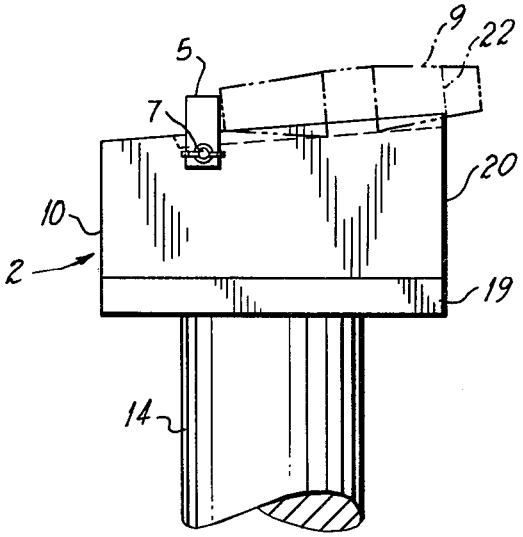
FIG. 1*a* shows a side view of the flipper holder.
Figure 1B:
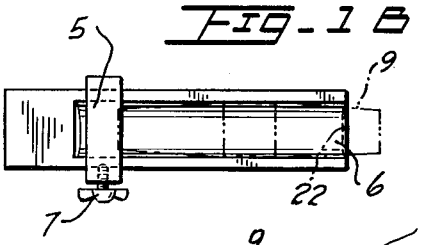
FIG. 1*b* is a top view of the holder.

The flipper holder 2 is attached to a platform 19 which in turn is secured to the upper cylinder 14. The platform 19 gives stability to the assembly. It also provides an alternative place to handle and adjust the position of the holder 2 without affecting the latter's settings. The holder 2 has a groove 6 that conforms to the cylindrical form of the flippers 9 (FIG. 1*a*) and said groove 6 in conjunction with detainer 5 keep the flippers in the desired position. The players adjust the detainer 5 with butterfly screw 7 so that one of the flipper's ends protrudes outwardly from the holder as shown in FIG. 1*a* in phantom line. The holder's rear end 10 is somewhat smaller than the holder's front end 20 thereby holding the flipper 9 at an angle with respect to the platform 19 and the floor. FIG. 1*b* is a top view of the holder illustrating how detainer 5 may be slid along groove 6 and tightened to the holder 2 by using butterfly screw 7.

Figure 2:
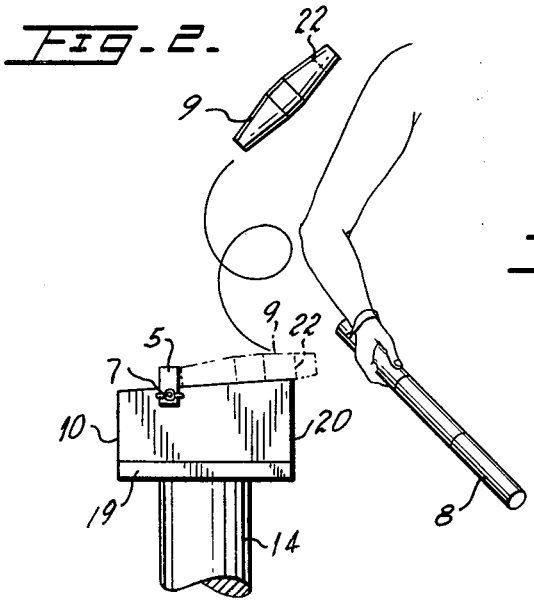
FIG. 2 illustrates a flipper, flipping up into the air after being struck for the first time.
Figure 2:
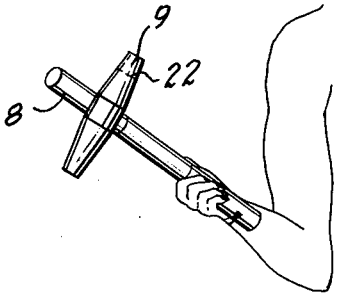
Figure 2A:
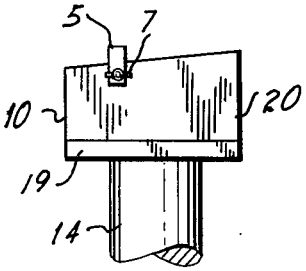
FIG. 2*a* illustrates a flipper being hit for the second time.

In FIG. 2, the flipper 9 is shown at rest in phantom lines and flying up into the air in solid lines after being struck with bat 8. FIG. 2*a* shows the flipper 9 being strick for the second time with the bat 8. Ideally, the player batting will hit the flipper 9 exactly in the middle in order to optimize the transferring of the momentum from the bat to the flipper.

Figure 3:
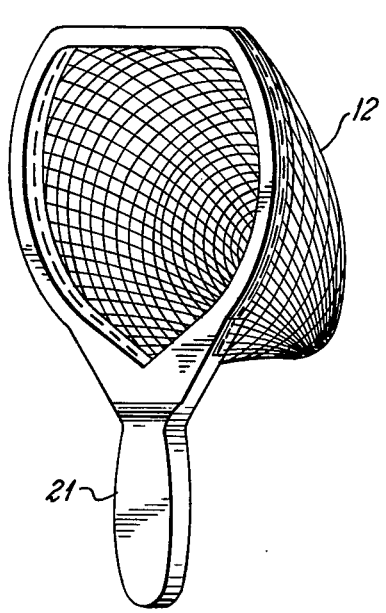
FIG. 3 shows a stopper at an angle.

FIG. 3 represents a stopper 11 used to catch the flipper safely. The stopper 11 resembles a racquet-ball racquet with the usual strings substituted for a net 12. The handle 21 may be an extension of the same racquet's material. The process for attaching the net 12 to the racquet's body is well know.

Figure 4:
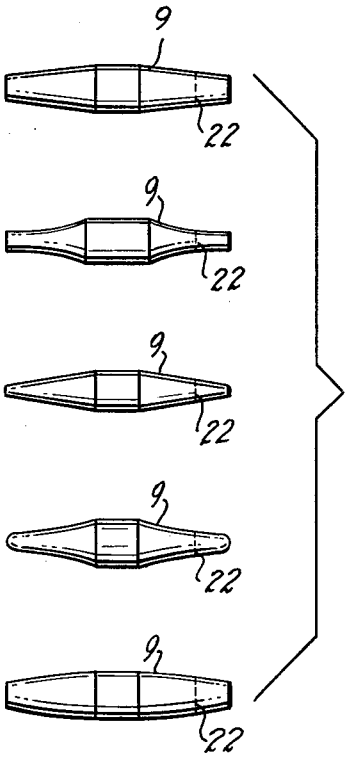
FIG. 4 shows the different models that may be used for playing the present game.

FIG. 4 shows different shapes and designs of flippers 9 that may be selected by the players according to their preference and experience. Also, a marking 22 is painted, etched or otherwise affixed to the flippers 9. This marking 22 is on one or both of the ends of the flippers 9 and it corresponds to the optimum protrusion of the flipper recommended by the inventors. If the marking 22 is aligned with the edge of the holder, the flipper will, after being hit for the first time, flip into the air vertically and upwardly with a slight displacement towards the end of the flipper that was hit. This slight displacement or separation from the holder 2 will permit the batter to make a free swing without worrying about hitting the holder 2.

Figure 5:
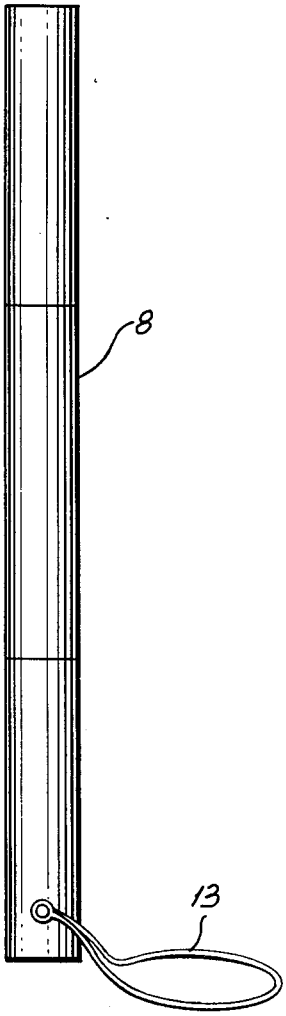
FIG. 5 is a front view of the bat.

In FIG. 5, a bat 8 is shown with a strap 13 attached to one end. The strap 13 is used to prevent the bat from accidentally slipping from the player's hand.

The game is played as follows: The field should be triangular in form and each side should be of the same length. One of the corners will be designated as the launch base where the batter is positioned. There are two teams and two captains. The number of players may vary and the size of the field may also vary accordingly. One of the teams will be batting while the other team plays in the field.

The game starts when one of the players of the team at the bat hits the flipper in the manner described above. The player will attempt to hit the flipper so that it will pass between the two other corners. If the flipper is caught by one of the players before touching ground, it is a fly and it will count as three outs. If the flipper touches the ground and it is caught while it is rolling, it will be one out.

Any time that the flipper lands outside the field delineated by the two corners opposite to the launch base, it will be considered a foul. Three fouls will be the equivalent of one out.

When the team on the field fails to catch the flipper, the opponent scores a point. After three outs, the team on the field earns the right to bat.

Many different and varied rules may be made to govern the playing of the game, so, therefore, we do not confine or limit ourselves to any particular manner or method of playing.

Having thus described our invention as relating to improvements in the implements used in playing games of this class, what we claim is:

1. A game outfit comprising:

(a) a flipper of circular cross section and elongated shape;

(b) a flipper holder, supporting said flipper, having a grooved holder base, a detainer having flanges and being slidably engaged for longitudinal movement on said grooved flipper holder's top surface and said detainer being adjustably secured to said grooved base by a butterfly screw piercing said detainer through one of said flanges;

(c) a platform attached to said flipper holder;

(d) an adjustable stand engaged to said platform;

(e) a base supporting the lower end of said stand;

(f) a bat; and (g) a stopper racquet.

2. A game outfit as described in claim 1 wherein said flipper is marked at a predetermined distance from one of the ends depending on weight and design whereby the batter insures a substantially vertical and upward flip of the flipper into the air.

* * * * *